US011024973B2

(12) United States Patent
Liu et al.

(10) Patent No.: US 11,024,973 B2
(45) Date of Patent: Jun. 1, 2021

(54) ANTENNA STRUCTURE

(71) Applicant: PEGATRON CORPORATION, Taipei (TW)

(72) Inventors: An-Shyi Liu, Taipei (TW); Jia-Fong Wu, Taipei (TW); Yung-Jen Cheng, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 0 days.

(21) Appl. No.: 16/667,676

(22) Filed: Oct. 29, 2019

(65) Prior Publication Data

US 2020/0168997 A1 May 28, 2020

(30) Foreign Application Priority Data

Nov. 23, 2018 (TW) ..... 107141917

(51) Int. Cl.
*H01Q 1/38* (2006.01)
*H01Q 9/04* (2006.01)
(Continued)

(52) U.S. Cl.
CPC ..... *H01Q 9/0457* (2013.01); *H01Q 1/246* (2013.01); *H01Q 1/38* (2013.01); *H01Q 9/065* (2013.01);
(Continued)

(58) Field of Classification Search
CPC ..... H01Q 9/0457; H01Q 1/246; H01Q 1/38; H01Q 9/065; H01Q 13/10; H01Q 21/08; H01Q 21/24
See application file for complete search history.

(56) References Cited

U.S. PATENT DOCUMENTS 5,923,296 A 7/1999 Sanzgiri et al.
6,466,171 B1 10/2002 Sherman et al.
(Continued)

FOREIGN PATENT DOCUMENTS

CN 101931122 12/2010
JP H09116311 5/1997
(Continued)

OTHER PUBLICATIONS

"Office Action of Korea Counterpart Application" with English translation thereof, dated Feb. 20, 2020, p. 1-p. 9.
(Continued)

*Primary Examiner* — Dieu Hien T Duong
(74) *Attorney, Agent, or Firm* — J.C. Patents

(57) ABSTRACT

An antenna structure includes an antenna pattern, a ground layer and two microstrip lines. The antenna pattern includes a first portion and a second portion. The first portion is rectangle shape and includes a first, a second, a third and a fourth sides. The second portion protrudes outwardly from the first side and the second side. The ground layer has two slots. Projections of the two slots to the antenna pattern are close to the third and the fourth sides. Projections of the two microstrip lines to the antenna pattern are perpendicular to the third and the fourth sides. Each microstrip line has a first section and a second section. Projection of the second section to the antenna pattern is closer to a center of the first portion than projection of the first section. A width of the first section is greater than a width of the second section.

10 Claims, 6 Drawing Sheets

(51) Int. Cl.

| | |
|---|---|
| ***H01Q 1/24*** | (2006.01) |
| ***H01Q 9/06*** | (2006.01) |
| ***H01Q 13/10*** | (2006.01) |
| ***H01Q 21/08*** | (2006.01) |
| ***H01Q 21/24*** | (2006.01) |

(52) U.S. Cl.
CPC ..... *H01Q 13/10* (2013.01); *H01Q 21/08* (2013.01); *H01Q 21/24* (2013.01)

(56) References Cited

U.S. PATENT DOCUMENTS

| | | | | |
|---|---|---|---|---|
| 6,549,166 | B2 * | 4/2003 | Bhattacharyya ..... | H01Q 9/0435 343/700 MS |
| 7,626,549 | B2 | 12/2009 | Channabasappa | |
| 2007/0296635 | A1 * | 12/2007 | Popugaev ..... | H01Q 5/364 343/700 MS |
| 2009/0256773 | A1 * | 10/2009 | Lindmark ..... | H01Q 9/0435 343/858 |
| 2013/0063310 | A1 | 3/2013 | Mak et al. | |
| 2015/0162663 | A1 | 6/2015 | Boryssenko et al. | |
| 2017/0365927 | A1 * | 12/2017 | Khan ..... | H01Q 9/0407 |

FOREIGN PATENT DOCUMENTS

| | | |
|---|---|---|
| JP | H10209743 | 8/1998 |
| JP | 2004530325 | 9/2004 |
| JP | 2006025035 | 1/2006 |
| JP | 2018082277 | 5/2018 |
| KR | 20020062396 | 7/2002 |
| KR | 20070071816 | 7/2007 |
| KR | 20160045649 | 4/2016 |

OTHER PUBLICATIONS

"Search Report of Europe Counterpart Application", dated Apr. 14, 2020, p. 1-p. 8.

* cited by examiner

ANTENNA STRUCTURE

CROSS-REFERENCE TO RELATED APPLICATION

This application claims the priority benefit of Taiwan application serial no. 107141917, filed on Nov. 23, 2018. The entirety of the above-mentioned patent application is hereby incorporated by reference herein and made a part of this specification.

BACKGROUND

Technology Field

The invention is related to an antenna structure, and particularly related to an antenna structure having a broadband and good return loss.

Description of Related Art

There are three metal layers in conventional coupled microstrip slot patch antennas. The middle metal layer is a ground plane. The upper metal layer is a patch antenna. The lower metal layer is a feed microstrip line. A dielectric plate is applied to separate the metal layers. A slot is configured on the middle metal layer, such that the microstrip line located below feeds input signals through the slot to feed the electric field to the patch antenna.

It is not easy to adjust the impedance matching for the conventional coupled microstrip slot patch antennas, the bandwidth of which is also limited by the modes excited by the size of the upper patch antenna. Therefore, the conventional patch antenna design has the disadvantage of narrow bandwidth. For example, the design of bandwidth of RFID frequency bands under American standard (0.902 GHz-0.928 GHz) fails to achieve the requirement of high return loss of 20 dB.

SUMMARY

The invention provides an antenna structure having a broadband and good return loss.

An antenna structure of the invention includes an antenna pattern, a ground layer, and two microstrip lines. The antenna pattern includes a first portion and a second portion. The first portion is a rectangular, which includes a first side, a second side, a third side and a fourth side connected in sequence. The second portion extends and protrudes outwardly from a corner formed by the first side and the second side. The ground layer is disposed below the antenna pattern and has two slots. Respective projections of the two slots projected onto the antenna pattern are close to the third side and the fourth side. The two microstrip lines are disposed below the ground layer. Respective projections of the two microstrip lines onto the antenna pattern are perpendicular to the third side and the fourth side, and Respective projections of the two microstrip lines onto the ground layer traverse the two slots. Each of the two microstrip lines has a first section and a second section in the extending direction. A projection of the second section onto the antenna pattern is closer to a center of the first portion than a projection of the first section to the antenna pattern, and the width of the first section is greater than the width of the second section.

In an embodiment of the invention, the antenna structure further includes a first circuit board and a second circuit board. The antenna pattern is disposed on a top surface of the first circuit board. The second circuit board is disposed below the first circuit board. The ground layer is disposed on a top surface of the second circuit board. The two microstrip lines are disposed on a bottom surface of the second circuit board.

In an embodiment of the invention, the antenna structure further includes a spacer, disposed between the first circuit board and the second circuit board.

In an embodiment of the invention, the antenna structure is suitable for resonating at a frequency band. A gap between the first circuit board and the second circuit board is 0.1 times a wavelength of the frequency band.

In an embodiment of the invention, the second portion is arranged in an L-shape.

In an embodiment of the invention, the length of the second portion protruding outwardly from the first side is between 0.05 times and 0.1 times the length of the fourth side, and the length of the second portion protruding outwardly from the second side is between 0.05 times and 0.1 times the length of the third side.

In an embodiment of the invention, the antenna structure is suitable for resonating at a frequency band. The length of each of the two microstrip lines is between 0.2 times and 0.3 times the frequency band.

In an embodiment of the invention, the width of the first section of each of the two microstrip lines is between 1.1 times and 2 times the width of the second section thereof.

In an embodiment of the invention, an extending direction of each of the slots is perpendicular to an extending direction of the corresponding microstrip line.

In an embodiment of the invention, the extending direction of one of the microstrip lines is perpendicular to the extending direction of the other one of the microstrip lines.

In view of the above, with the design that the width of the first section is greater than the width of the second section thereof, the antenna structure of the invention is able to adjust impedance matching. Matched with the antenna pattern of the antenna structure of the invention, the second portion extends and protrudes outwardly from the corner formed by the first side and the second side, such that the antenna structure of the invention is an antenna having a broadband and good return loss.

To make the aforementioned and other features and advantages of the invention more comprehensible, several embodiments accompanied with figures are described in detail as follows.

DETAILED DESCRIPTION

Figure 1:
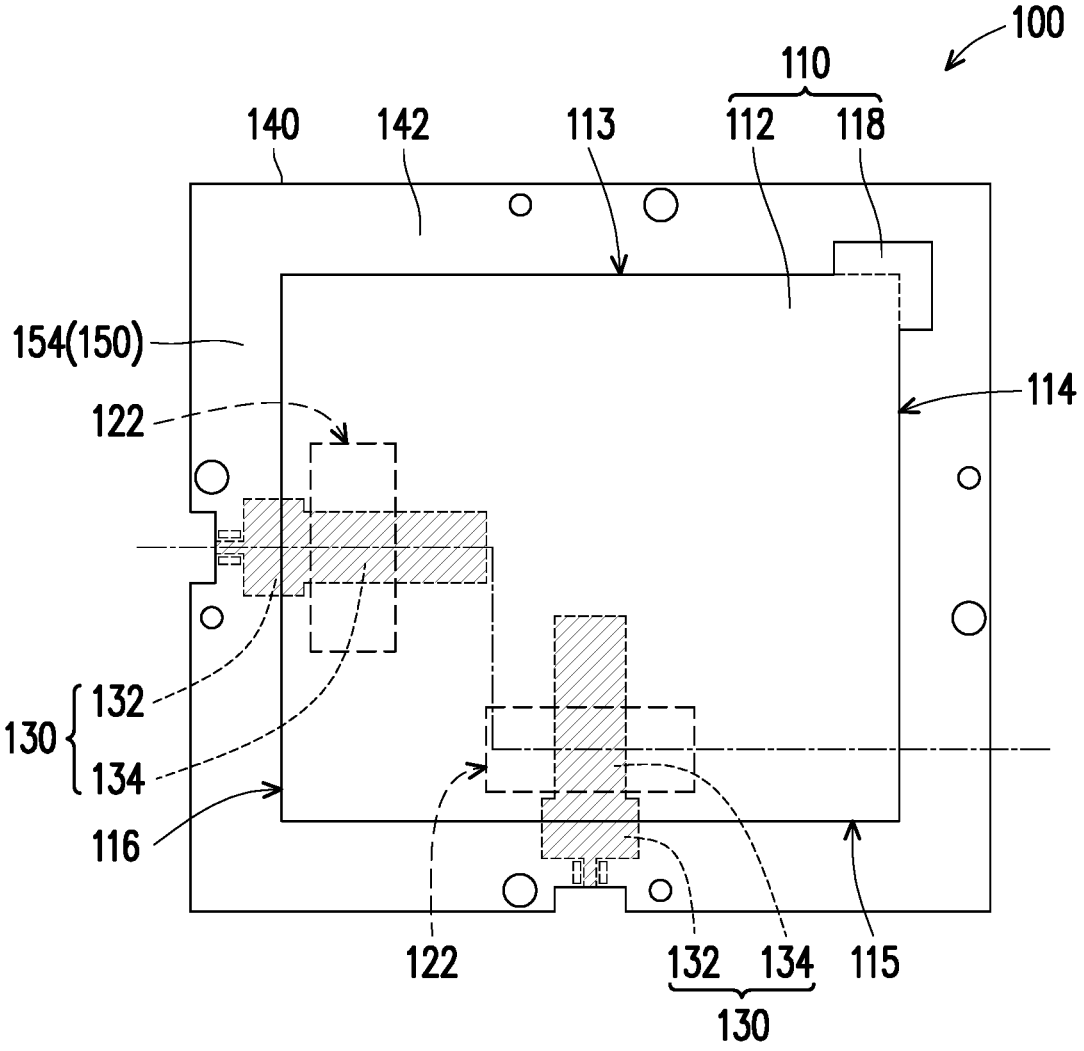
FIG. 1 is a schematic top view of an antenna structure according to an embodiment of the invention.
Figure 2:
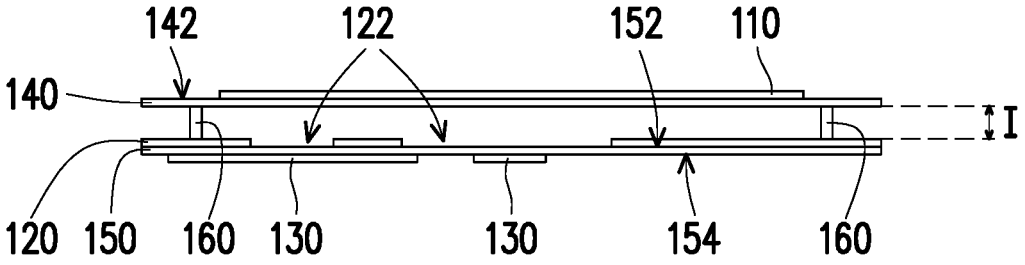
FIG. 2 is a schematic cross-sectional view of an antenna structure of FIG. 1.

FIG. 1 is a schematic top view of an antenna structure according to an embodiment of the invention. FIG. 2 is a schematic cross-sectional view of an antenna structure of FIG. 1. It should be noted that in FIG. 1, a ground layer 120 and a microstrip line 130 are both located below an antenna pattern 110, and are thus illustrated in broken lines. Furthermore, the cross section of FIG. 2 is a schematic cross-sectional view along the curved broken lines in FIG. 1.

Please refer to FIG. 1 and FIG. 2. The antenna structure 100 is an example of a coupled microstrip slot dual-feeding patch antenna according to an embodiment of the present invention. However, the types of the antenna structure 100 shall not be limited thereto. In this embodiment, the antenna structure 100 has a broadband and high return loss, suitable for the applications of different kinds of RFID readers. The application frequency band of the antenna structure 100 is, for example, from 0.902 GHz to 0.928 GHz. Indeed, the application and the frequency band of the antenna structure 100 shall not be limited thereto.

Figure 3:
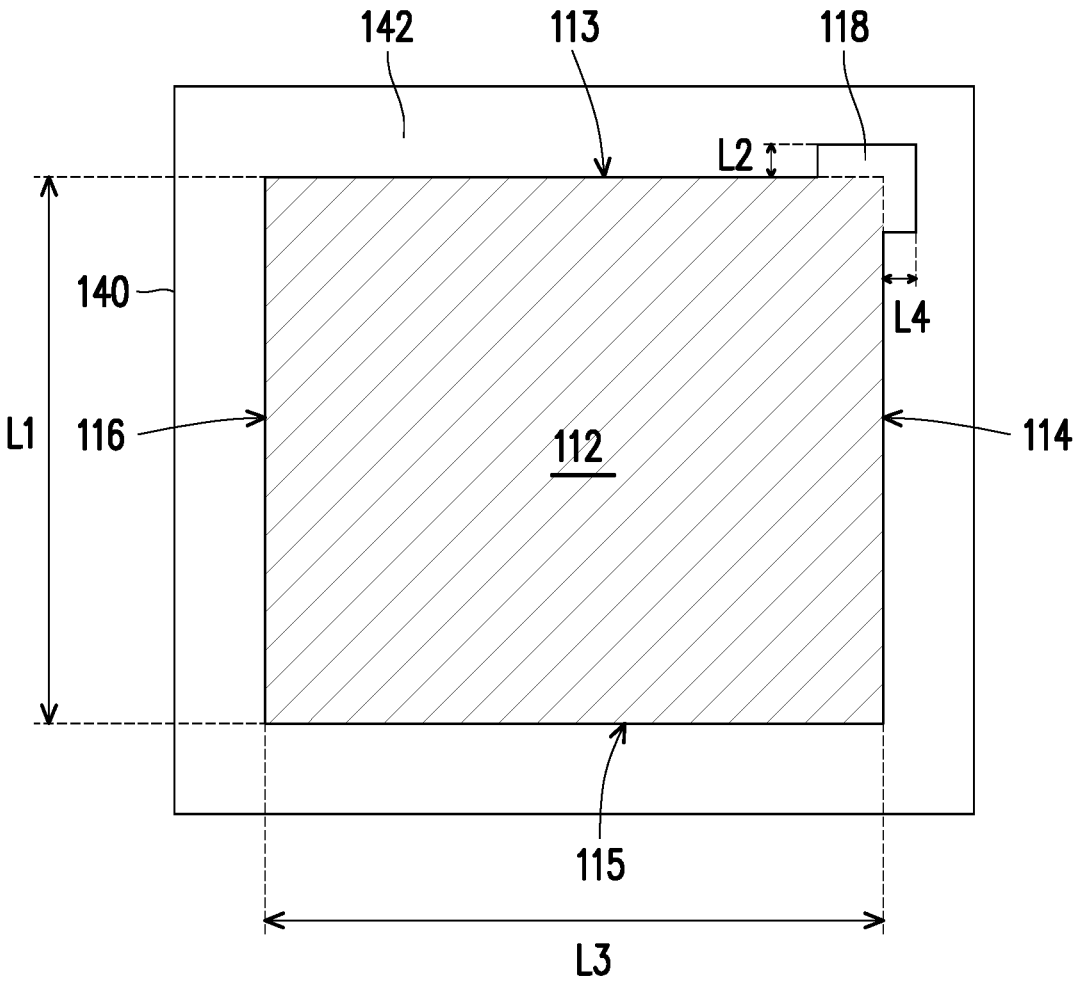
FIG. 3 is a schematic top view of a first circuit board of the antenna structure of FIG. 1.

It can be seen from FIG. 2 that the antenna structure 100 of the embodiment includes, from top to the bottom, an antenna pattern 110, a ground layer 120, and two microstrip lines 130. FIG. 3 is a schematic top view of a first circuit board of the antenna structure 100 of FIG. 1. Please refer to FIG. 1 and FIG. 3 together. In this embodiment, the antenna pattern 110 is, for example, a patch antenna. As illustrated in FIG. 1, the antenna pattern 110 includes a first portion 112 and a second portion 118. The first portion 112 has a rectangle shape, for example, a rectangle or a square. The first portion 112 has a rectangle shape, which includes a first side 113, a second side 114, a third side 115 and a fourth side 116 connected in sequence. The second portion 118 extends and protrudes outwardly from a corner formed by the first side 113 and the second side 114.

The second portion 118 of the antenna pattern 110 is configured to allow the frequency band at which the first portion 112 resonates to slightly shift toward low frequency, such that the overall frequency band is widened. In this embodiment, the second portion 118 is arranged in an L-shape. Indeed, the shape of the second portion 118 shall not be limited thereto. In other embodiments, the second portion 118 may be in a ¾ circular shape, a serrated shape, or other irregular shapes. As illustrated in FIG. 3, in this embodiment, the length L2 of the second portion 118 protruding outwardly from the first side 113 is between 0.05 times and 0.1 times the length L1 of the fourth side 116, and the length L4 of the second portion 118 protruding outwardly from the second side 114 is between 0.05 times and 0.1 times the length L3 of the third side 115. Upon testing, the length relationship mentioned above allows the antenna pattern 110 to have better impedance matching. Indeed, the length relationship of the lengths L1 and L2 shall not be limited thereto.

Figure 4:
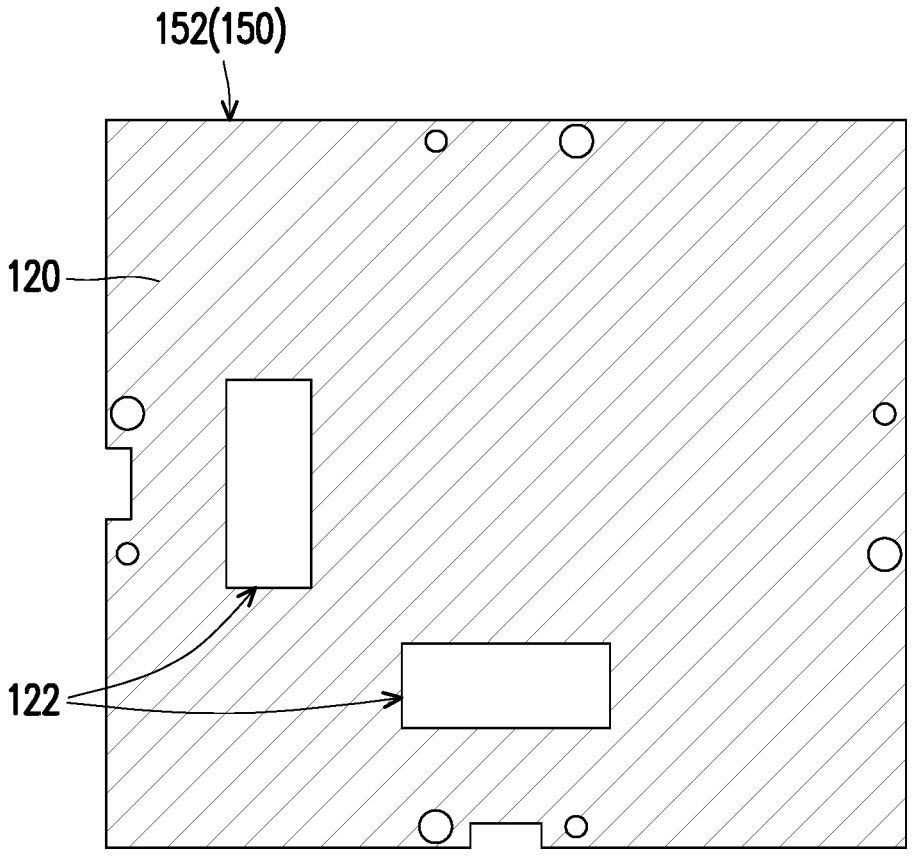
FIG. 4 is a schematic top view of a second circuit board of the antenna structure of FIG. 1.

FIG. 4 is a schematic top view of a second circuit board of the antenna structure of FIG. 1. Please refer to FIG. 1 and FIG. 4. The ground layer 120 is disposed below the antenna pattern 110. The ground layer 120 is a metal layer and has two slots 122. It can be seen from FIG. 1, respective projections of the two slots 122 projected onto the antenna pattern 110 are close to the third side 115 and the fourth side 116.

Figure 5:
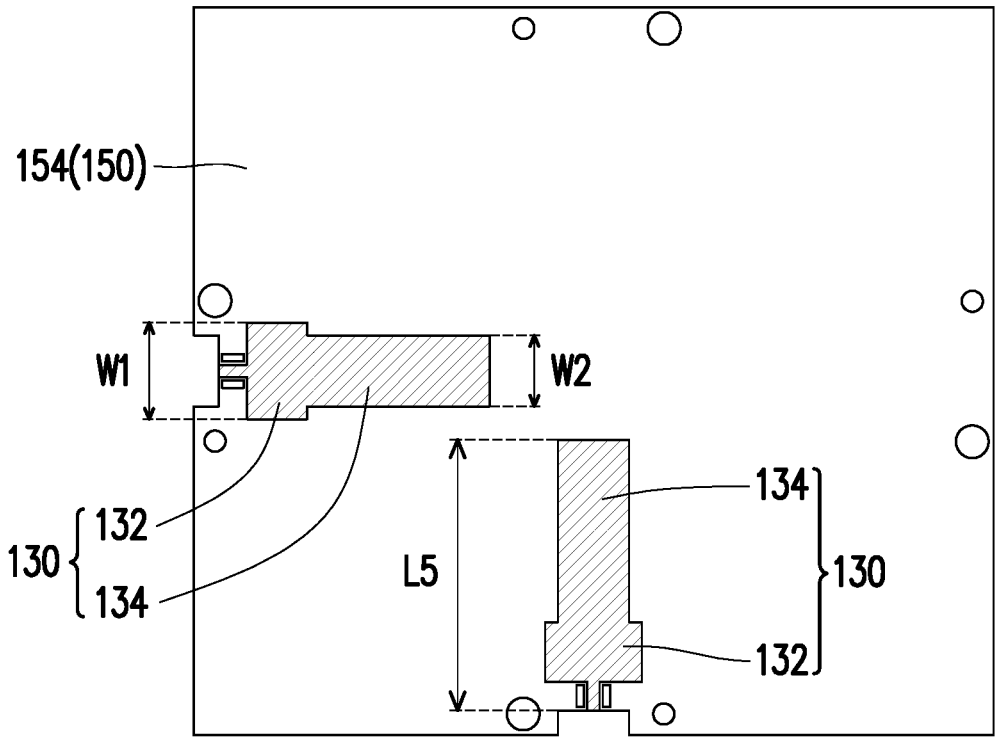
FIG. 5 is a schematic bottom view of a second circuit board of the antenna structure of FIG. 1.

As illustrated in FIG. 2, the two microstrip lines 130 are disposed below the ground layer 120. FIG. 5 is a schematic bottom view of a second circuit board of the antenna structure of FIG. 1. Please refer to FIG. 1 and FIG. 5. Respective projections of the two microstrip lines 130 projected onto the antenna pattern 110 are perpendicular to the third side 115 and the fourth side 116, and respective projections of the two microstrip lines 130 onto the ground layer 120 traverse the two slots 122. In this embodiment, each of the two microstrip lines 130 has a first section 132 and a second section 134 in the extending direction. A projection of the second section 134 onto the antenna pattern 110 is closer to a center of the first portion 112 than a projection of the first section 132 onto the antenna pattern 110, and the width of the first section 132 is greater than the width of the second section 134.

With the design that projections of the microstrip lines 130 onto the antenna pattern 110 traverse the positions of the third side 115 and the fourth side 116 and that the width of the first section 132 is greater than the width of the second section 134, the antenna structure 100 of the invention is able to adjust impedance matching. The aforementioned design cooperates with the antenna pattern 110 to provide the antenna structure 110 with a broadband and high return loss though the second portion 118 extending and protruding outwardly from a corner formed by the first side 113 and the second side 114.

In this embodiment, the extending direction of one of the microstrip lines 130 is perpendicular to the extending direction of the other microstrip line 130, and the extending direction of each of the slots 122 is perpendicular to the extending direction of the corresponding microstrip line 130. Indeed, in other embodiments, the extending directions of the two microstrip line 130 shall not be limited thereto. In addition, the relationship between the extending direction of each of the slots 122 and the extending direction of the corresponding microstrip line 130 shall not be limited thereto.

With reference back to FIG. 2, in this embodiment, the antenna structure 100 further includes a first circuit board 140, a second circuit board 150, and a spacer 160. The antenna pattern 110 is disposed on a top surface 142 of the first circuit board 140. The second circuit board 150 is disposed below the first circuit board 140. The ground layer 120 is disposed on a top surface 152 of the second circuit board 150. The two microstrip lines 130 are disposed on a bottom surface 154 of the second circuit board 150. The spacer 160 is disposed between the first circuit board 140 and the second circuit board 150 to separate the first circuit board 140 and the second circuit board 150, and to keep a certain distance between the antenna pattern 110 and the ground layer 120. In this embodiment, the spacer 160 is, for example, a plastic post. However, the type of the spacer 160 shall not be limited thereto.

In this embodiment, the antenna structure 100 is suitable for resonating at a frequency (e.g., from 0.902 GHz to 0.928 GHz). A gap between the first circuit board 140 and the second circuit board 150 is 0.1 times a wavelength of the frequency band, which is about 5 mm to 10 mm.

It should be noted that, in other embodiments, the antenna structure 100 may be a single circuit board design. That is, the antenna pattern 110, the ground layer 120, and the two microstrip lines 130 are separately in different layers of the same circuit board. The antenna pattern 110 and the ground layer 120 are separated by two dielectric layers so are the ground layer 120 and the two microstrip lines 130. The thickness of the dielectric layer between the antenna pattern 110 and the ground layer 120 may be about 0.1 times the wavelength of the frequency band at which the antenna structure 100 resonates.

Furthermore, it can be seen from FIG. 5 that in this embodiment, the length of each of the two microstrip lines 130 is between 0.2 times and 0.3 times the wavelength of the frequency band, for example, 0.25 times the wavelength. In addition, the width of the first section 132 of each of the two microstrip lines 130 is between 1.1 times and 2 times the width of the second section 134. Upon testing, when the microstrip lines 130 are in the aforementioned scopes, the antenna structure 100 has higher return loss.

Figure 6:
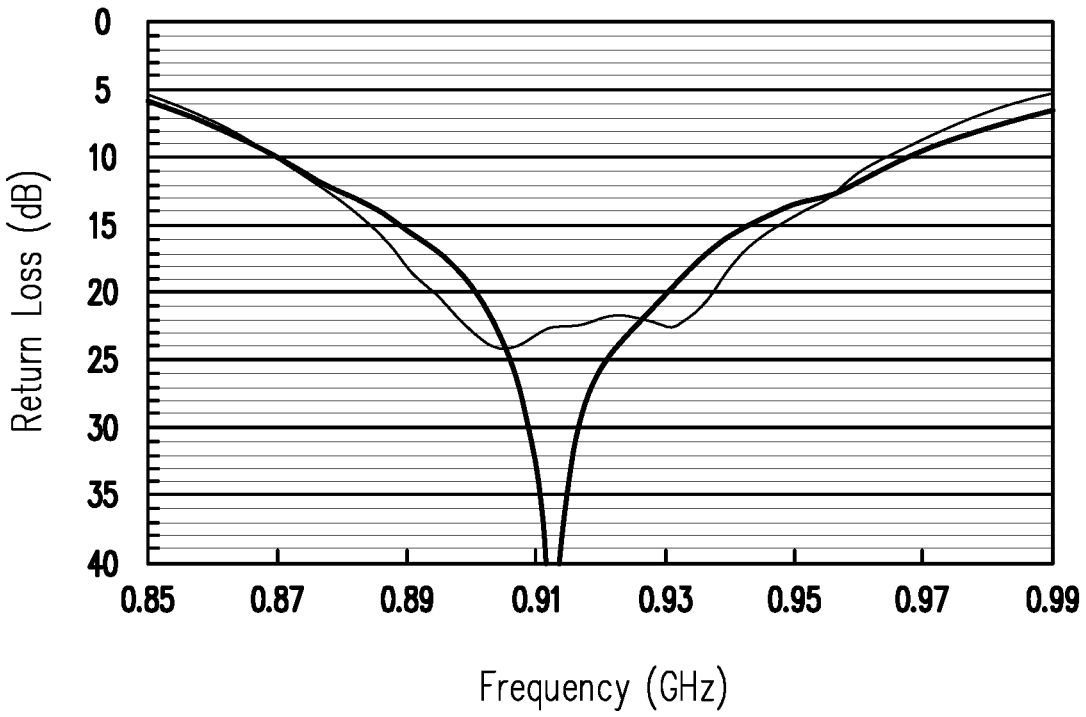
FIG. 6 is a plot of frequency-return loss of the antenna structure of FIG. 1.

FIG. 6 is a plot of frequency-return loss of the antenna structure of FIG. 1. Please refer to FIG. 6. In this embodiment, the antenna structure 100 is fed by the microstrip line 130 at the edge of the second circuit board 150. Since there are two microstrip lines 130, the antenna structure 100 has two feeding ports. The resonant mode obtained at the lower feeding port in FIG. 1 (that is, from the lower microstrip line 130 at the edge of the second circuit board 150) is indicated by bold lines. The resonant mode obtained at the feeding port on the left in FIG. 1 (i.e., from the left microstrip line 130 at the edge of the second circuit board 150) is indicated by a thin line. It can be seen from FIG. 6 that the return loss of the resonant modes obtained at the two feeding ports in the frequency band from 0.902 GHz to 0.928 GHz is greater than or equal to 20 dB, and has good performance.

In summary of the above, with the design that the width of the first section is greater than the width of the second section, the antenna structure of the invention is able to adjust impedance matching. In the cooperation with the antenna pattern of the antenna structure of the invention the antenna structure of the invention achieves a broadband and high return loss through the second portion extending and protruding outwardly from the corner formed by the first side and the second side.

It will be apparent to those skilled in the art that various modifications and variations can be made to the disclosed embodiments without departing from the scope or spirit of the invention. In view of the foregoing, it is intended that the invention covers modifications and variations of this disclosure provided that they fall within the scope of the following claims and their equivalents.

What is claimed is:

1. An antenna structure, comprising:

an antenna pattern, comprising a first portion and a second portion, the first portion being rectangular and having a first side, a second side, a third side and a fourth side connected in sequence, the second portion extending and protruding outwardly from a corner formed by the first side and the second side;

a ground layer, disposed below the antenna pattern and having two slots, respective projections of the two slots projected onto the antenna pattern being close to the third side and the fourth side; and two microstrip lines, disposed below the ground layer, respective projections of the two microstrip lines projected onto the antenna pattern being perpendicular to the third side and the fourth side, and respective projections of the two microstrip lines projected onto the ground layer traversing the two slots, each of the two microstrip lines having a first section and a second section in an extending direction, a projection of the second section projected onto the antenna pattern being closer to a center of the first portion than a projection of the first section, and a width of the first section being greater than a width of the second section.

2. The antenna structure according to claim 1, further comprising:

a first circuit board, wherein the antenna pattern is disposed on a top surface of the first circuit board; and a second circuit board, disposed below the first circuit board, wherein the ground layer is disposed on a top surface of the second circuit board, and the two microstrip lines are disposed on a bottom surface of the second circuit board.

3. The antenna structure according to claim 2, further comprising:

a spacer, disposed between the first circuit board and the second circuit board.

4. The antenna structure according to claim 2, wherein the antenna structure is suitable for resonating at a frequency band, a gap between the first circuit board and the second circuit board is 0.1 times a wavelength of the frequency band.

5. The antenna structure according to claim 1, wherein the second portion is arranged in an L-shape.

6. The antenna structure according to claim 1, wherein a length of the second portion protruding outwardly from the first side is between 0.05 times and 0.1 times a length of the fourth side and a length of the second portion protruding outwardly from the second side is between 0.05 times and 0.1 times a length of the third side.

7. The antenna structure according to claim 1, wherein the antenna structure is suitable for resonating at a frequency band, a length of each of the microstrip lines is between 0.2 times and 0.3 times the frequency band.

8. The antenna structure according to claim 1, wherein a width of the first section of each of the microstrip lines is between 1.1 times and 2 times a width of the second section thereof.

9. The antenna structure according to claim 1, wherein an extending direction of each of the slots is perpendicular to an extending direction of the corresponding microstrip line.

10. The antenna structure according to claim 1, wherein an extending direction of one of the microstrip lines is perpendicular to an extending direction of the other one of the microstrip lines.

* * * * *